US009599076B2

(12) United States Patent
Powell

(10) Patent No.: US 9,599,076 B2
(45) Date of Patent: Mar. 21, 2017

(54) FUEL TANK LOCKING RING MOUNTED FUEL PUMP CONTROLLER

(75) Inventor: Patrick Powell, Farmington Hills, MI (US)

(73) Assignees: Denso International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 1745 days.

(21) Appl. No.: 13/039,549

(22) Filed: Mar. 3, 2011

(65) Prior Publication Data

US 2012/0222655 A1 Sep. 6, 2012

(51) Int. Cl.
*F02M 37/04* (2006.01)
*F02M 37/10* (2006.01)

(52) U.S. Cl.
CPC ..... *F02M 37/103* (2013.01); *F02M 37/106* (2013.01)

(58) Field of Classification Search
CPC .. B01D 35/0273; B01D 35/26; F02M 37/103; F02M 37/106; F02M 37/10
USPC ..... 123/198 C, 495, 497, 509; 137/583, 584, 137/585, 586
See application file for complete search history.

(56) References Cited

U.S. PATENT DOCUMENTS

| | | | | |
|---|---|---|---|---|
| 5,102,172 | A * | 4/1992 | Seizert et al. | 292/256.6 |
| 5,207,463 | A | 5/1993 | Seizert et al. | |
| 6,637,778 | B2 | 10/2003 | Benjey | |
| 7,040,298 | B2 | 5/2006 | Nakamura et al. | |
| 7,497,208 | B2 * | 3/2009 | Satoh et al. | 123/509 |
| 7,806,109 | B2 * | 10/2010 | Tateishi et al. | 123/509 |
| 7,827,969 | B2 * | 11/2010 | Yamamoto et al. | 123/509 |
| 7,954,476 | B2 * | 6/2011 | Murakoshi et al. | 123/509 |
| 2005/0100461 | A1 * | 5/2005 | Izutani et al. | 417/423.8 |
| 2007/0062841 | A1 | 3/2007 | Nakamura et al. | |
| 2007/0253845 | A1 * | 11/2007 | Suzuki | 417/423.8 |
| 2007/0284006 | A1 * | 12/2007 | Suzuki et al. | 137/565.01 |
| 2010/0051621 | A1 | 3/2010 | Shimoda et al. | |
| 2011/0139128 | A1 * | 6/2011 | Zhang et al. | 123/509 |
| 2011/0192381 | A1 * | 8/2011 | Maruyama et al. | 123/497 |

FOREIGN PATENT DOCUMENTS

| | | |
|---|---|---|
| JP | 2010-112183 | 5/2010 |
| KR | 2000-0042013 | 7/2000 |

OTHER PUBLICATIONS

Office action dated Dec. 11, 2013 in corresponding Korean Application No. 10-2012-0021298.

* cited by examiner

*Primary Examiner* — Sizo Vilakazi
(74) *Attorney, Agent, or Firm* — Harness, Dickey & Pierce, P.L.C.

(57) ABSTRACT

A fuel supply system for a vehicle includes a fuel pump module with a fuel pump module flange at a surface thereof. A lock ring is removably secured to the fuel pump module flange and to a fuel tank for retaining the fuel pump module to the fuel tank. An extension member is secured to the lock ring and extends a distance from the fuel pump module. A fuel pump controller is in communication with the vehicle and the fuel pump module for relaying signals therebetween. The fuel pump controller is fixedly secured to the extension member.

20 Claims, 5 Drawing Sheets

FUEL TANK LOCKING RING MOUNTED FUEL PUMP CONTROLLER

FIELD

The present disclosure relates to a support for a fuel pump controller, and more particularly, to a fuel tank locking ring mounted fuel pump controller.

BACKGROUND

The statements in this section merely provide background information related to the present disclosure and may not constitute prior art. Current fuel pump modules may provide a fuel pump controller mounted to a vehicle trunk or mounted under a vehicle hood. A disadvantage to this mounting arrangement is that an extensive amount of wiring is required between the fuel pump controller and the fuel pump module. This wiring increases the cost of the overall design, provides electro-radiated emissions in undesirable areas and causes voltage drops across the wire length, which reduces overall vehicle electrical efficiency. While consideration has been given to securing the fuel pump controller to the fuel pump module flange, such a design has also presented challenges. That is, because fuel pump controllers generate some quantity of heat and an adequate heat sink is required, flange sizes to act as heat sinks for a mounted controller have historically been undesirably large and thus have prevented design advancement. What is needed then is a fuel pump controller mounting arrangement that does not suffer from the above disadvantages.

SUMMARY

This section provides a general summary of the disclosure, and is not a comprehensive disclosure of its full scope or all of its features. A fuel supply system for a vehicle may include a fuel pump module with a fuel pump module flange at a surface thereof. A lock ring may be removably secured to the fuel pump module flange and to a fuel tank for retaining the fuel pump module to the fuel tank. An extension member may be secured to the lock ring and extend a distance from the fuel pump module. A fuel pump controller may be in communication with the vehicle and the fuel pump module for relaying signals therebetween. The fuel pump controller may be secured in a fixed manner to the extension member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
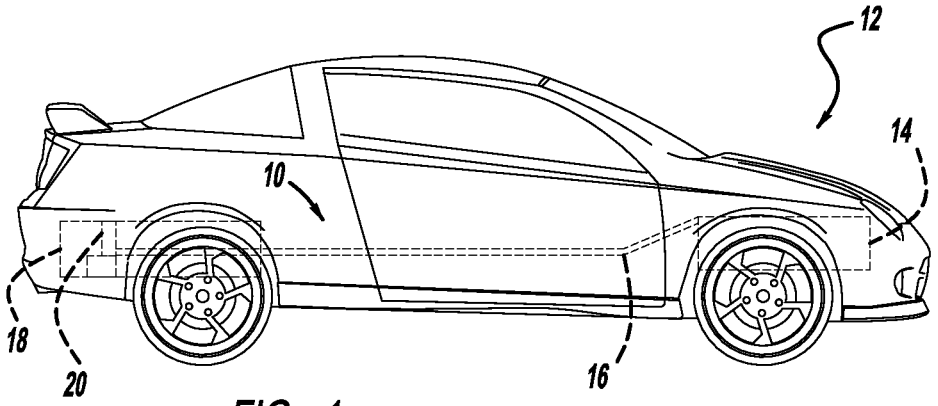
FIG. 1 is a side view of a vehicle depicting a location of a fuel supply system.

The following description is merely exemplary in nature and is not intended to limit the present disclosure, application, or uses. Throughout the drawings, corresponding reference numerals indicate like or corresponding parts and features. Turning now to FIGS. 1-9, features and details of the present teachings will be presented.

Figure 2:
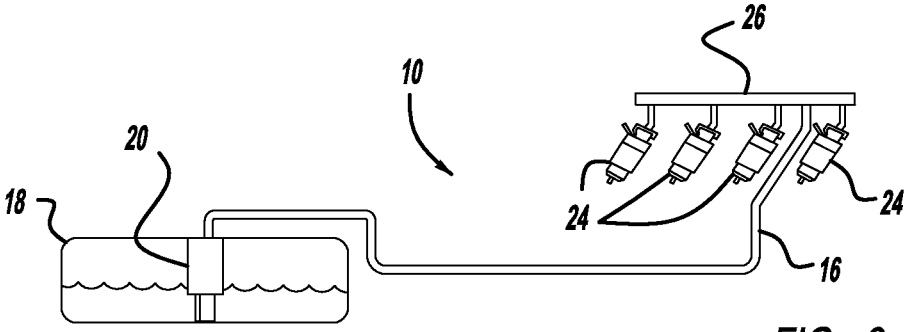
FIG. 2 is a side view of the fuel supply system depicting a fuel pump module within a fuel tank.

FIGS. 1 and 2 depict a fuel supply system 10 for a vehicle 12, such as an automobile. The vehicle 12 includes an engine 14, a fuel supply line 16, a fuel tank 18, and a fuel pump module 20. The fuel pump module 20 mounts within the fuel tank 18 and is normally submerged in or surrounded by varying amounts of liquid fuel within the fuel tank 18 when the fuel tank 18 possesses liquid fuel. A fuel pump 22 (FIG. 4) within the fuel pump module 20 pumps fuel to the engine 14 through the fuel supply line 16. The fuel supply system 10 includes a plurality of fuel injectors 24 for supplying fuel to the engine 14. In a returnless fuel system, the fuel supply line 16 carries fuel from the fuel pump module 20 to a fuel injector rail 26 (also referred to as a "common rail"). After reaching the injector rail 26, fuel passes into the individual fuel injectors 24 before being sprayed or injected into individual combustion chambers of the engine 14. As should be understood, in the returnless fuel system, the fuel supply system 10 has no fuel return line from the injector rail 26 back to the fuel tank 18.

Figure 3:
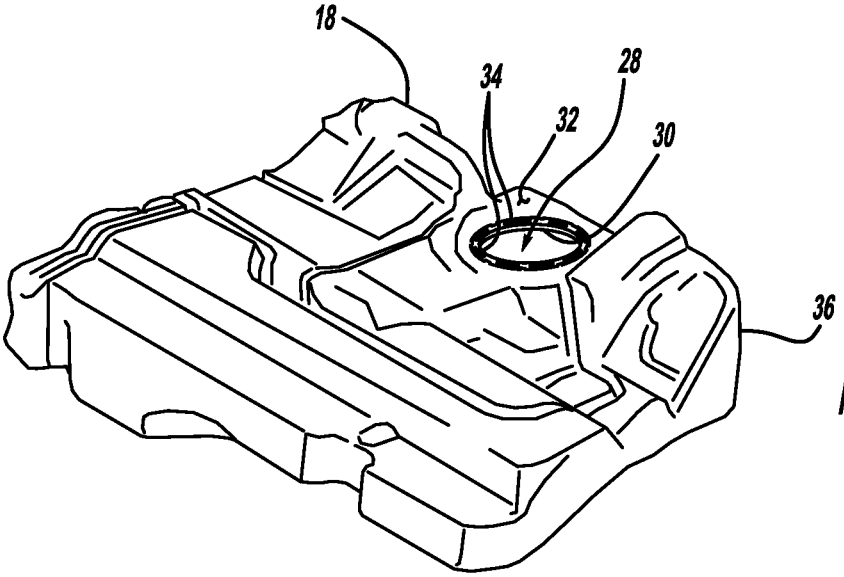
FIG. 3 is a perspective view of the fuel tank depicting an aperture for installation of the fuel pump module.

With reference now including FIG. 3, the vehicle fuel tank 18 includes a mounting location 28 (e.g., a circular hole 30) within a top or an upper surface 32 of the fuel tank 18 for receipt of the fuel pump module 20 and a plurality of extending tabs 34 circumscribing the hole 30. It should be noted, however, that the mounting location 28 may be in any configuration known in the art. For example, the mounting location 28 may be an alternate shape (e.g., rectangular) and/or may be located at a side surface 36 of the fuel tank 18. The extending tabs 34 may be arranged symmetrically around the hole 30 as shown. In this way, the extending tabs 34 evenly supply the force necessary to retain the fuel pump module 20 to the fuel tank 18, as will be described in more detail below. Alternately, the extending tabs 34 may be located asymmetrically to allow for packaging constraints.

Figure 4:
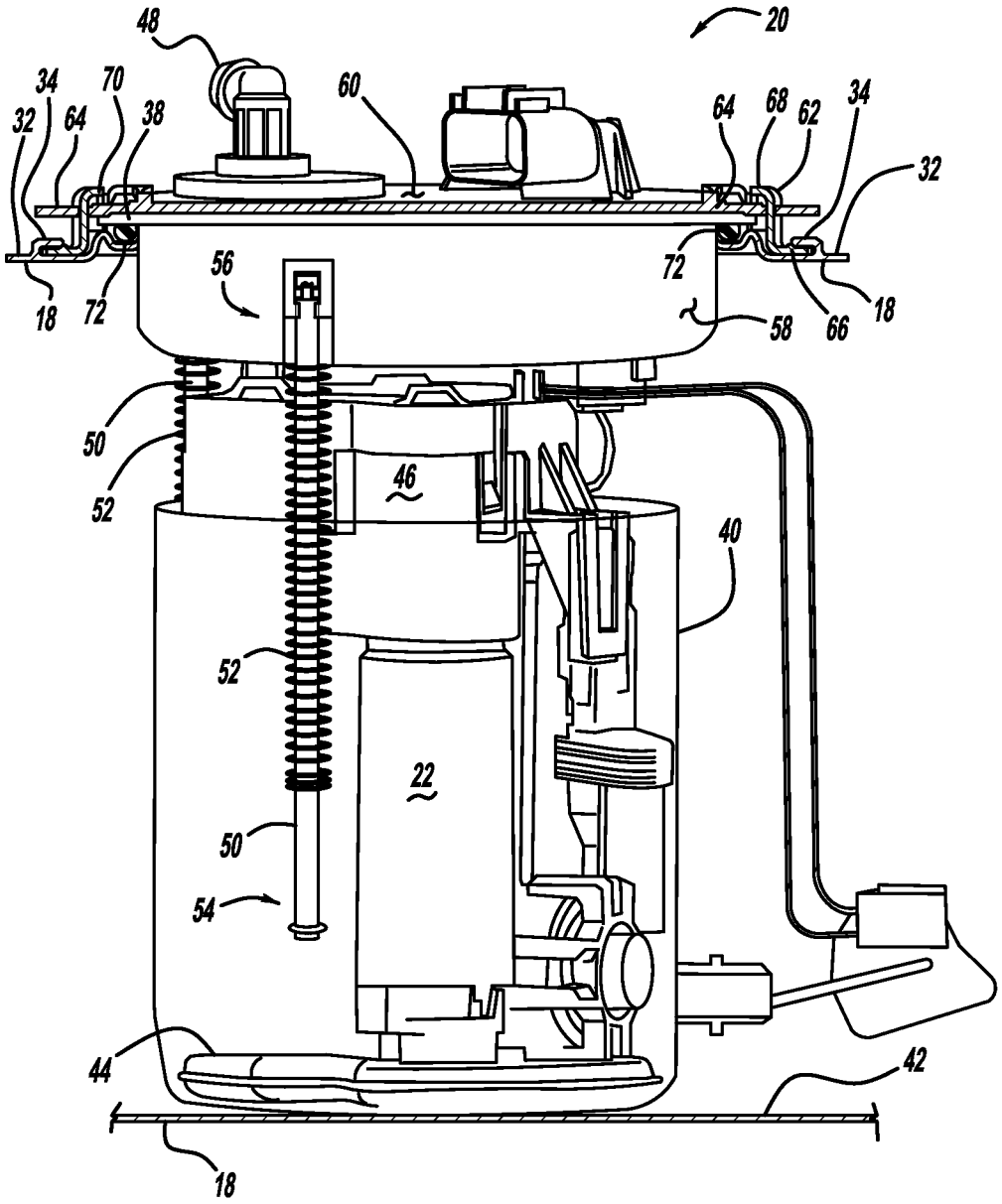
FIG. 4 is a side view of the fuel pump module of the fuel supply system.

With reference now including FIG. 4, in one embodiment, the fuel pump module 20 may be lowered through the hole 30 at the mounting location 28 of the fuel tank 18 during installation. More specifically, a fuel pump module flange 38 may be spaced a predetermined distance from the upper surface 32 of the fuel tank 18 when the fuel pump module 20 is in its installed position. Alternatively, the fuel pump module flange 38 may rest on at least a portion of the upper surface 32 of the fuel tank 18 when the fuel pump module 20 is in its installed position. The fuel pump module 20 is shown as a generally vertical cylindrical reservoir 40. However, the fuel pump module 20 may also be oriented generally horizontally (not shown). An advantage to horizontal orientation is that less depth within the fuel tank 18 is necessary for accommodating the fuel pump module 20. Similarly, the vertically oriented reservoir 40 requires less horizontal space for installation. Furthermore, the vertically oriented reservoir 40 may be firmly biased against a bottom interior surface 42 of the fuel tank 18. That is, generally, the vertically-oriented reservoir 40 may have a smaller overall diameter than a horizontally oriented counterpart within the same vehicle application.

Continuing with reference to FIG. 4, the fuel pump module 20 includes the at least one fuel pump 22 for drawing fuel from the reservoir 40 and through a filter sock 44 and, in one example, fuel pump 22 pumps fuel through a fuel pump check valve 46 that may be disposed at or near the top of the fuel pump 22. The fuel pump check valve 46 opens in response to positive pressure from within the fuel pump 22 to permit fuel to flow from the top of the fuel pump 22 and into the fuel supply line 16 via a fuel supply line port 48.

To pump fuel as generally described above, the fuel pump module 20 resides securedly against the bottom interior surface 42 of the fuel tank 18. For example, to maintain the fuel pump module 20 against the bottom interior surface 42 of the fuel tank 18, a plurality of rods 50 each surrounded by a spring 52 may be located around the exterior of the reservoir 40. A lower end 54 of each rod 50 may be secured to the reservoir 40, such as by press fitting into the reservoir 40, by crimping the lower end 54, or by installing a locking washer (not shown) at the lower end 54 after passing through a portion of the reservoir 40 (e.g., through a flange within the reservoir 40). An upper end 56 of each rod 50 may be firmly secured to the reservoir 40 at the flange 38 by a press or snap fit. More specifically, the upper end 56 may pass through a vertical wall 58 that is perpendicular to a horizontal top 60 of the flange 38.

Additionally, the fuel pump module 20 may be retained in position through the use of a retaining ring 62 and lock ring 64 arrangement. The retaining ring 62 may be an annular device formed from a metallic material, such as a metal that is commonly used for metal fuel tanks in automobiles. Such a metal may be steel and may be further alloyed, coated or both. In one example, such an alloy or coating may include all of, or combinations of, zinc, lead, and antimony. With a base metal of steel and with or without a coating as presented above, heat absorption and heat transfer characteristics of the retaining ring 62, in conjunction with heat dissipation of surrounding parts, may be achieved. Moreover, the retaining ring 62 may be an annular device formed from a metallic material having a lower portion 66 interconnected with a plurality of discrete upper arms 68. The lower portion 66 of the retaining ring 62 may be sized to receive the fuel pump module 20, while being secured to the fuel tank 18. In one embodiment, the lower portion 66 of the retaining ring 62 may be secured in a fixed manner to the fuel tank 18 with an adhesive. In another embodiment, the lower portion 66 of the retaining ring 62 may be removably secured to the extending tabs 34 of the fuel tank 18 through mechanical fixation. For example, the lower portion 66 of the retaining ring 62 may have a plurality of slots (not shown) corresponding in position to the extending tabs 34. Rotation of the retaining ring 62 may secure the lower portion 66 of the ring 62 to the fuel tank 18. Beneficially, in this arrangement, the retaining ring 62 may be easily removed for maintenance.

The discrete upper arms 68 of the retaining ring 62 may extend perpendicularly from the lower portion 66 to a distance above the fuel pump module flange 38 and terminate at an upper elbow or bend 70. The distance above the fuel pump module flange 38 corresponds to a thickness of the lock ring 64. In this way, the lock ring 64 may be braced against the horizontal top 60 of the flange 38 through interaction with the bend 70 in the upper arms 68 of the retaining ring 62. The lock ring 64 may also incorporate a plurality of slots corresponding to the discrete upper arms 68 of the retaining ring 62 and may be an annular device formed from a metallic material, which may be the same as presented above in conjunction with the retaining ring 62.

A gasket or O-ring 72 may be retained at an interface between the fuel tank 18 and the fuel pump module flange 38 to provide a seal for preventing the escape of liquid or vapor fuel from the fuel tank 18. The O-ring 72 may be maintained in a position against the vertical wall 58 and below the horizontal top 60 of the flange 38 by the contour of the upper surface 32 of the fuel tank 18. It should be understood, however, that any device for sealingly retaining the fuel pump module 20 to the fuel tank 18 may be used in place of the O-ring 72 arrangement.

Figure 5:
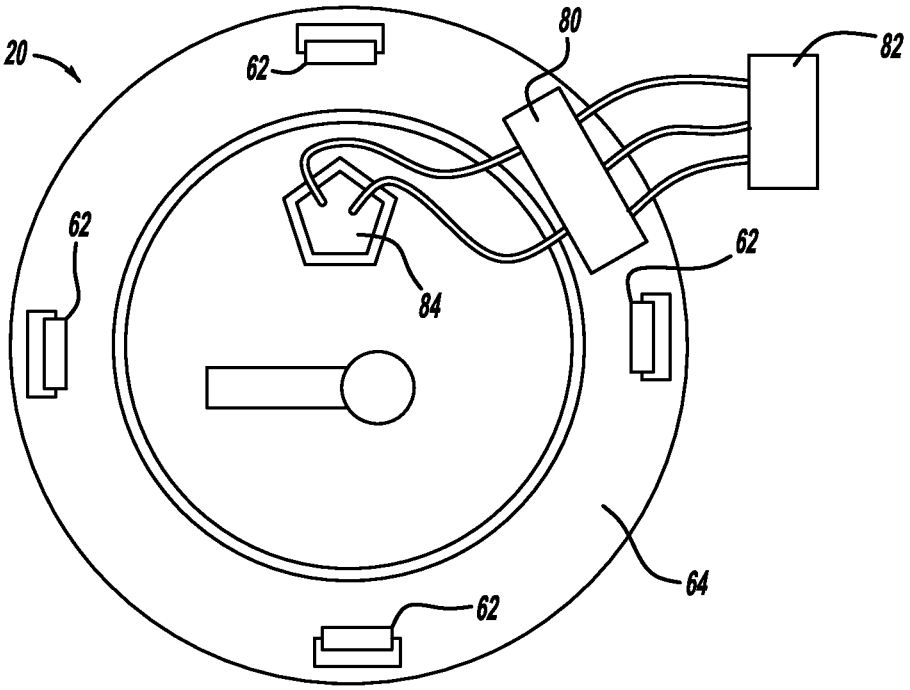
FIG. 5 is a top view of a first mounting arrangement for a fuel pump controller in communication with the fuel pump module.

With reference now to FIG. 5, the fuel pump module 20 may be controlled by a fuel pump controller 80 in communication with a vehicle electrical connector 82 and a module electrical connector 84. Electrical signals representative of vehicle 12 and fuel pump module 20 functions are relayed between the fuel pump controller 80, the vehicle electrical connector 82, and the module electrical connector 84. The fuel pump controller 80 may be mounted directly to the lock ring 64. As previously discussed, the lock ring 64 may be a sturdy and rigid metallic component. The size of the lock ring 64 and its material composition provide a natural heat sink that can absorb the output heat of the fuel pump controller 80 and dissipate it to the surrounding environment. The fuel pump controller 80 is secured directly adjacent to the fuel pump module 20 to provide the benefit of elimination of wires between the fuel pump controller 80 and the fuel pump module 20. Accordingly, module costs and electro-radiated emissions can be reduced. Furthermore, voltage drops associated with wire length are also reduced, thus improving the overall vehicle electrical efficiency.

Figure 6:
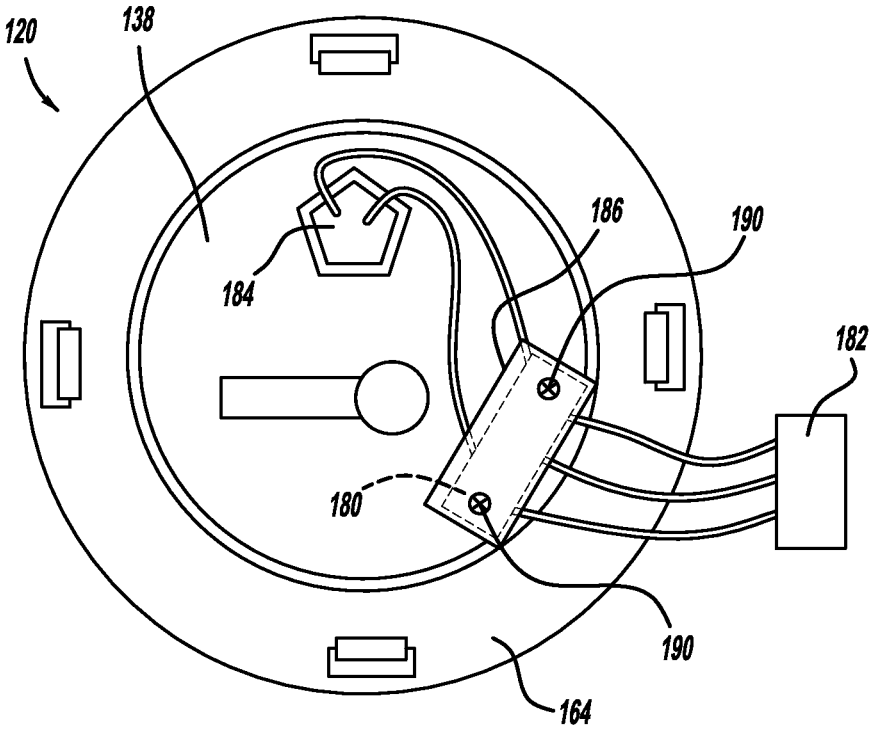
FIG. 6 is a top view of a second mounting arrangement for a fuel pump controller in communication with the fuel pump module.
Figure 7:
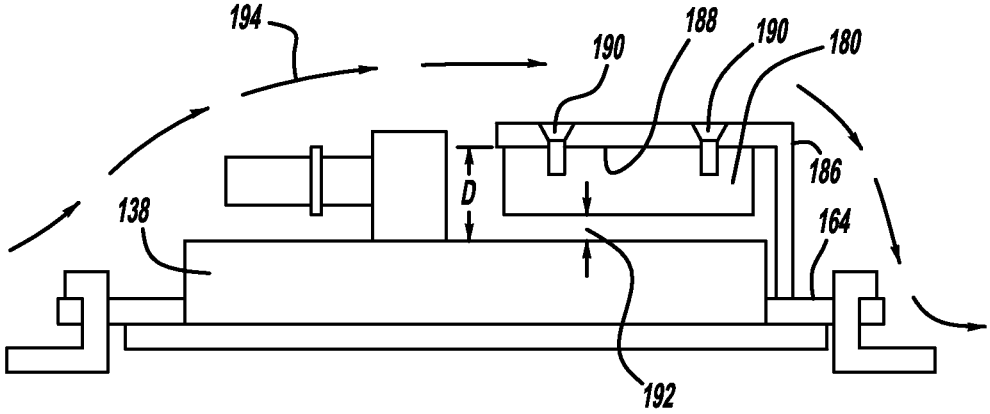
FIG. 7 is a side view of the second mounting arrangement of FIG. 6.

An alternative mounting arrangement for a fuel pump controller 180 is depicted in FIGS. 6 and 7. Various components are common between the fuel pump controller 80 (FIG. 5) and the fuel pump controller 180. For this reason, like reference numbers are used to denote like components previously discussed. For example, a fuel pump module 120 may be controlled by the fuel pump controller 180 in communication with a vehicle electrical connector 182 and a module electrical connector 184. Electrical signals representative of vehicle 12 and fuel pump module 120 functions are relayed between the fuel pump controller 180, the vehicle electrical connector 182, and the module electrical connector 184.

In this alternative mounting arrangement, a metallic bracket 186 (e.g., aluminum) may extend from a lock ring 164 at a predetermined distance D from a fuel pump module flange 138. A first portion of the bracket 186 may extend perpendicularly from the lock ring 164, and another, second portion may extend perpendicularly from the first portion. The second portion may be parallel to a top surface of the flange 138. The bracket 186 may be removably secured to the lock ring 164, such as by "twisting" to lock within any number of the plurality of slots (not shown) of the lock ring 164. The fuel pump controller 180 may be mounted to the bracket 186 at an undersurface 188 thereof by a plurality of fasteners 190 (e.g., simple screws, lock washers, threaded fasteners, etc). In this way, the fuel pump controller 180 is disposed above the fuel pump module flange 138 with a gap 192 between the fuel pump controller 180 and the fuel pump module flange 138. Thus, because the controller 180 is located between the second portion of the bracket 186 and the flange 138, the controller 180 is protected on various sides from contact, such as during assembly or during use on a vehicle. Thus, bracket 186 may be a cantilever type of bracket to thereby conserve material in comparison to non-cantilever brackets. Air circulation through the gap 192 allows for air circulation around the fuel pump controller 180 to cool the fuel pump controller 180. Given the location of the lock ring 164 above the fuel pump module 120, an under-vehicle air slipstream (represented by arrows 194) further assists in managing heat output from the fuel pump controller 180. In another way, heat is removed as air flows over the fuel tank 18.

Figure 8:
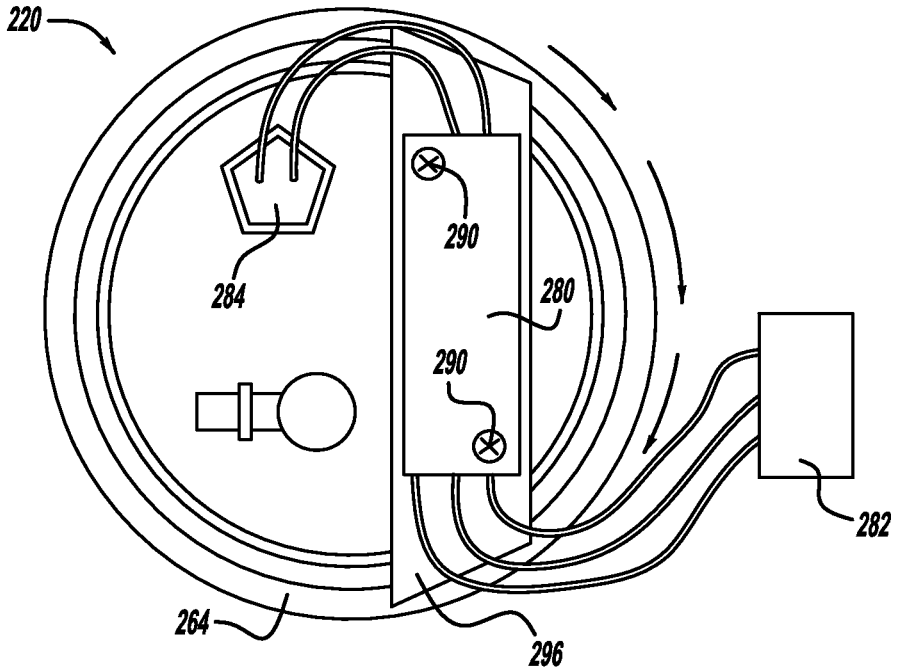
FIG. 8 is a top view of a third mounting arrangement for a fuel pump controller in communication with the fuel pump module.
Figure 9:
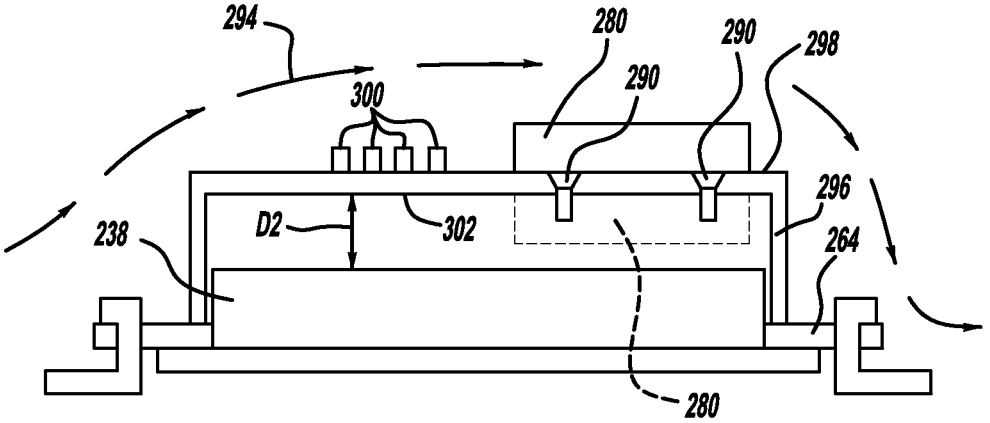
FIG. 9 is a side view of the third mounting arrangement of FIG. 8.

Another alternative mounting arrangement for a fuel pump controller 280 is depicted in FIGS. 8 and 9. Various components are common between the fuel pump controller 80 and the fuel pump controller 280. For this reason, like reference numbers are used to denote like components previously discussed. For example, a fuel pump module 220 may be controlled by the fuel pump controller 280 in communication with a vehicle electrical connector 282 and a module electrical connector 284. Electrical signals representative of vehicle 12 and fuel pump module 220 functions are relayed between the fuel pump controller 280, the vehicle electrical connector 282 and the module electrical connector 284.

In this alternative mounting arrangement, a metallic bridge 296 (e.g., aluminum) may extend from a lock ring 264 at a predetermined distance D2 from a fuel pump module flange 238. The bridge 296 may be a non-cantilever type of bracket in that more than one leg, such as two legs as depicted in FIG. 9, may be used to connect a bracket portion (to which the fuel pump controller 280 is mounted) to the lock ring 264. Bracket portion to which the fuel pump controller 280 is mounted may be parallel to a top surface or flange 238 and define distance D2 therebetween. The portion of the bridge 296 that actually contacts the flange 238 may be perpendicular to flange 238 and the portion of the bridge that the fuel pump controller 280 actually contacts. Depending upon the material used for the bridge 296, vibration experienced by the bridge 296 may be less with a two or more leg design as depicted in FIG. 9 as opposed to a cantilever design as depicted in FIG. 7.

The bridge 296 may be removably secured to the lock ring 264, such as by "twisting" to lock within any number of the plurality of slots (not shown) of the lock ring 264. The fuel pump controller 280 may be mounted to the metallic bridge 296 at a top surface 298 thereof by a plurality of fasteners 290 (e.g., simple screws, lock washers, threaded fasteners, etc). In this way, the fuel pump controller 280 is disposed above the fuel pump module flange 238, allowing for an under-vehicle air slipstream (represented by arrows 294) to assist in managing heat output from the fuel pump controller 280. Furthermore, a plurality of fins 300 may be incorporated into the bridge 296 to provide for an additional cooling mechanism. It should be noted that while the fuel pump controller 280 is described as being secured to the top surface 298 of the bridge 296, it is also contemplated that the fuel pump controller 280 may be secured to an under surface 302 of the bridge 296 (e.g., as shown in dashed lines).

While the bracket 186 and the bridge 296 are described being removably fastened to the lock ring 164, 264 by twist locking, it is also contemplated that the bracket 186 and the bridge 296 may be fixedly secured to the lock ring 164, 264. For example, the bracket 186 and the bridge 296 may be integrally formed with the lock ring 264 or may be joined in a secondary operation (e.g., welding or bolting).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel supply system for a vehicle, comprising:

a fuel pump module;

a fuel pump module flange at a surface of the fuel pump module;

a lock ring removably secured to the fuel pump module flange and to a fuel tank, the lock ring retaining the fuel pump module to the fuel tank;

an extension member secured to the lock ring, wherein the extension member extends a distance from the fuel pump module; and a fuel pump controller in communication with the vehicle and the fuel pump module for relaying signals therebetween, the fuel pump controller secured to the extension member such that the fuel pump controller is spaced apart from both the fuel pump module flange and the lock ring to define a gap between the fuel pump controller and both the fuel pump module flange and the lock ring.

2. The fuel supply system of claim 1, wherein the fuel pump controller is secured to an undersurface of the extension member.

3. The fuel supply system of claim 1, wherein the fuel pump controller is secured to a top surface of the extension member.

4. The fuel supply system of claim 1, wherein the extension member is one of a cantilever bracket and a bridge member.

5. The fuel supply system of claim 1, wherein the extension member is formed from a metallic material.

6. The fuel supply system of claim 5, wherein the metallic material is aluminum.

7. The fuel supply system of claim 1, wherein a first portion of the extension member extends perpendicularly from the lock ring.

8. The fuel supply system of claim 7, wherein a second portion of the extension member is interconnected with the first portion at an elbow, the first and second portions being unitarily formed.

9. The fuel supply system of claim 1, wherein the extension member is removably retained within a plurality of slots in the lock ring.

10. A fuel pump controller bracket, comprising:

a lock ring removably secured to a fuel pump module flange;

a first arm extending perpendicularly to the lock ring;

a second arm extending perpendicularly to the first arm and at a distance to the lock ring, the second arm having an upper surface and a lower surface; and a fuel pump controller secured to at least one of the upper and the lower surfaces of the second arm such that the fuel pump controller is spaced apart from both the fuel pump module flange and the lock ring to define a gap between the fuel pump controller and both the fuel pump module flange and the lock ring, the fuel pump controller does not extend through either the fuel pump module flange or the lock ring.

11. The fuel pump controller bracket of claim 10, wherein:

the fuel pump controller is secured to the second arm, and the fuel pump controller and the fuel pump module flange define the gap therebetween.

12. The fuel pump controller bracket of claim 11, wherein the second arm is metal, the second arm further comprising heat fins to conduct heat from the fuel pump controller.

13. A fuel pump module, comprising:

a fuel pump module flange at a surface of the fuel pump module;

a lock ring removably securing the fuel pump module flange to a fuel tank;

a retaining ring secured to the fuel tank, the retaining ring securing the lock ring to the fuel tank;

an extension member having a first portion extending at a first angle to the lock ring, a second portion at a second angle to the first portion, and an elbow unitarily connecting the first and second portions; and a fuel pump controller fixedly secured to the second portion of the extension member such that the fuel pump controller is spaced apart from the fuel pump module flange, the lock ring, and the retaining ring to define a gap between the fuel pump controller and both the fuel pump module flange and the lock ring, the fuel pump controller does not extend through either the fuel pump module flange or the lock ring.

14. The fuel pump module of claim 13, wherein the first portion is extends at a ninety degree angle to the lock ring and the second portion extends at a ninety degree angle to the first portion, and the fuel pump controller is secured to an undersurface of the second portion of the extension member.

15. The fuel pump module of claim 13, wherein the fuel pump controller is secured to a top surface of the extension member.

16. The fuel pump module of claim 13, wherein the extension member is one of a cantilever bracket and a bridge member.

17. The fuel pump module of claim 13, wherein the extension member is formed from a metallic material.

18. The fuel pump module of claim 17, wherein the second portion is parallel to the lock ring and the fuel pump controller is secured to an undersurface of the second portion of the extension member.

19. The fuel pump module of claim 13, wherein the second portion of the extension member and the fuel pump module define an air gap therebetween.

20. The fuel pump module of claim 19, wherein:

the first portion extends at a ninety degree angle to the lock ring, the second portion is parallel to the lock ring, and the fuel pump controller is secured to an undersurface of the second portion of the extension member.

* * * * *